US008226459B2

(12) United States Patent
Barrett et al.

(10) Patent No.: US 8,226,459 B2
(45) Date of Patent: Jul. 24, 2012

(54) HANDHELD WAGERING GAME MACHINE AND DOCKING UNIT

(75) Inventors: Shawn O. Barrett, Libertyville, IL (US); Jared L. Fritts, Chicago, IL (US); James M. Rasmussen, Chicago, IL (US); Norman R. Wurz, Des Plaines, IL (US)

(73) Assignee: WMS Gaming, Inc., Waukegan, IL (US)

( * ) Notice: Subject to any disclaimer, the term of this patent is extended or adjusted under 35 U.S.C. 154(b) by 331 days.

(21) Appl. No.: 12/513,622

(22) PCT Filed: Nov. 9, 2007

(86) PCT No.: PCT/US2007/084354

§ 371 (c)(1),
(2), (4) Date: May 11, 2009

(87) PCT Pub. No.: WO2008/061040

PCT Pub. Date: May 22, 2008

(65) Prior Publication Data

US 2010/0069160 A1 Mar. 18, 2010

Related U.S. Application Data

(60) Provisional application No. 60/865,373, filed on Nov. 10, 2006, provisional application No. 60/955,266, filed on Aug. 10, 2007.

(51) Int. Cl.
*G07F 17/00* (2006.01)

(52) U.S. Cl. ..... 463/7

(58) Field of Classification Search ..... 463/7–9, 463/16–25

See application file for complete search history.

(56) References Cited

U.S. PATENT DOCUMENTS

| | | | | |
|---|---|---|---|---|
| 2001/0044337 | A1 | 11/2001 | Rowe et al. | |
| 2002/0193099 | A1 | 12/2002 | Paulsen | |
| 2005/0070358 | A1 | 3/2005 | Angell et al. | |
| 2006/0035707 | A1 | 2/2006 | Nguyan | |
| 2006/0238365 | A1 | 10/2006 | Vecchione et al. | |
| 2006/0252496 | A1 | 11/2006 | Rasmussen | |
| 2008/0254862 | A1 * | 10/2008 | Mattice et al. | 463/25 |
| 2009/0005165 | A1 * | 1/2009 | Arezina et al. | 463/37 |
| 2010/0016075 | A1 * | 1/2010 | Thomas | 463/30 |

OTHER PUBLICATIONS

"PCT Application No. PCT/US2007/084354 International Preliminary Report on Patentability", Jun. 29, 2009 , 8 pages.
"PCT Application No. PCT/US2007/084354 International Search Report", May 5, 2008 , 11 pages.

* cited by examiner

*Primary Examiner* — Ronald Laneau
(74) *Attorney, Agent, or Firm* — DeLizio Gilliam, PLLC

(57) ABSTRACT

Embodiments of a handheld wagering game machine and docking station are described herein. In one embodiment, the wagering game docking station is configured to dock with a handheld wagering game machine. The docking station can include a docking port configured to receive and adjustably hold the handheld wagering game machine at any of a plurality of viewing angles. The docking station can also include a plurality of buttons configured to send input to the handheld wagering game machine. The docking station can also include a mounting member configured to mount the docking station to a surface.

18 Claims, 19 Drawing Sheets

SECTION
A-A

HANDHELD WAGERING GAME MACHINE AND DOCKING UNIT

RELATED APPLICATIONS

This application claims the priority benefit of U.S. Provisional Application Ser. No. 60/865,373 filed Nov. 10, 2006 and U.S. Provisional Application Ser. No. 60/955,266 filed Aug. 10, 2007.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2007, WMS Gaming, Inc.

FIELD

Embodiments of the inventive subject matter relate generally to wagering game systems, and more particularly to handheld wagering game machines and docking stations.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

This document describes an apparatus comprising a wagering game docking station configured to dock with a handheld wagering game machine, the docking station including, a docking port configured to receive and adjustably hold the handheld wagering game machine at any of a plurality of viewing angles; a plurality of buttons configured to send input to the handheld wagering game machine; and a mounting member configured to mount the docking station to a surface.

In some embodiments, the docking port is further configured to provide data and power to the handheld wagering game machine.

In some embodiments, one of the buttons includes an organic light emitting diode configured to present graphical content.

In some embodiments, the docking station is further configured to rotate about the mounting member after being mounted to the surface.

In some embodiments, the mounting member is further configured to plug into a mounting socket that is fastened to the underside to the surface.

In some embodiments, the docking station is further including a support member, wherein the mounting member is slidably attached to the support member.

This document also describes an apparatus comprising a handheld wagering game machine configured to present wagering games, the handheld wagering game device including, a first enclosure configured to contain components including, a central processing unit (CPU) configured to process information about the wagering games; a power supply configured to provide power to the CPU; a display device configured to display the information about wagering games; and a second enclosure to contain the first enclosure, the second enclosure including a display opening, the display opening surrounding the display device.

In some embodiments, the second enclosure is also containing a peripheral device.

In some embodiments, the second enclosure is also containing a card reader connected to the CPU.

In some embodiments, the first enclosure further includes a docking port configured to connect the handheld wagering game machine to a docking station.

In some embodiments, the display device is flush to the display opening.

In some embodiments, the first enclosure also includes a power switch, and wherein the second enclosure includes a power switch actuator connected to the power switch.

In some embodiments, the second enclosure is suitable for insertion into a docking port of a docking station.

In some embodiments, the first enclosure contains a power switch connected to the power supply, and wherein the second enclosure includes a switch actuator connected to the power switch.

This document also describes a wagering game system comprising a docking station configured to be mounted on a surface, the docking station including, a plurality of buttons configured to receive input associated with wagering games; and a docking port configured to provide power and information associated with the wagering games; and a handheld wagering game machine configured to dock with the docking station, the handheld wagering game machine including, a display device configured to consume the power and to present some of the information; and a wagering game unit configured to receive the input and present the wagering games.

In some embodiments, the docking port is further configured to hold the handheld wagering game machine at any one of a plurality of user selected viewing angles.

In some embodiments, the docking port includes a pivotable connection cylinder configured to support the handheld wagering game machine at a plurality of present viewing angles.

In some embodiments, the handheld wagering game machine includes a primary enclosure and a secondary enclosure.

In some embodiments, the handheld wagering game machine further includes, a primary enclosure configured to contain the display device and the wagering game unit; and a secondary enclosure configured to contain the primary enclosure and a peripheral device.

In some embodiments, the docking station includes a mounting member configured to mount the docking station to the surface, and wherein the docking station is further configured to rotate about the mounting member after being mounted to the surface.

In some embodiments, the handheld wagering game machine further includes one or more contact surfaces for wirelessly for receiving power, and wherein the wagering game system further includes a charging pad configured to provide power to the handheld wagering game machine when the wagering game machine's contact surfaces are in contact with the charging pad.

In some embodiments, the handheld wagering game machine includes an RF receiver configured to use energy in RF signals to charge a battery, and wherein the wagering game system further includes one or more RF transmitters configured to transmit RF signals for charging the battery of the handheld wagering game machine.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention. The second section describes example architectures, while the third section provides some implementation details. The fourth section provides some general comments.

INTRODUCTION

This section provides an introduction to embodiments of a handheld wagering game machine and docking stations.

Figure 1:
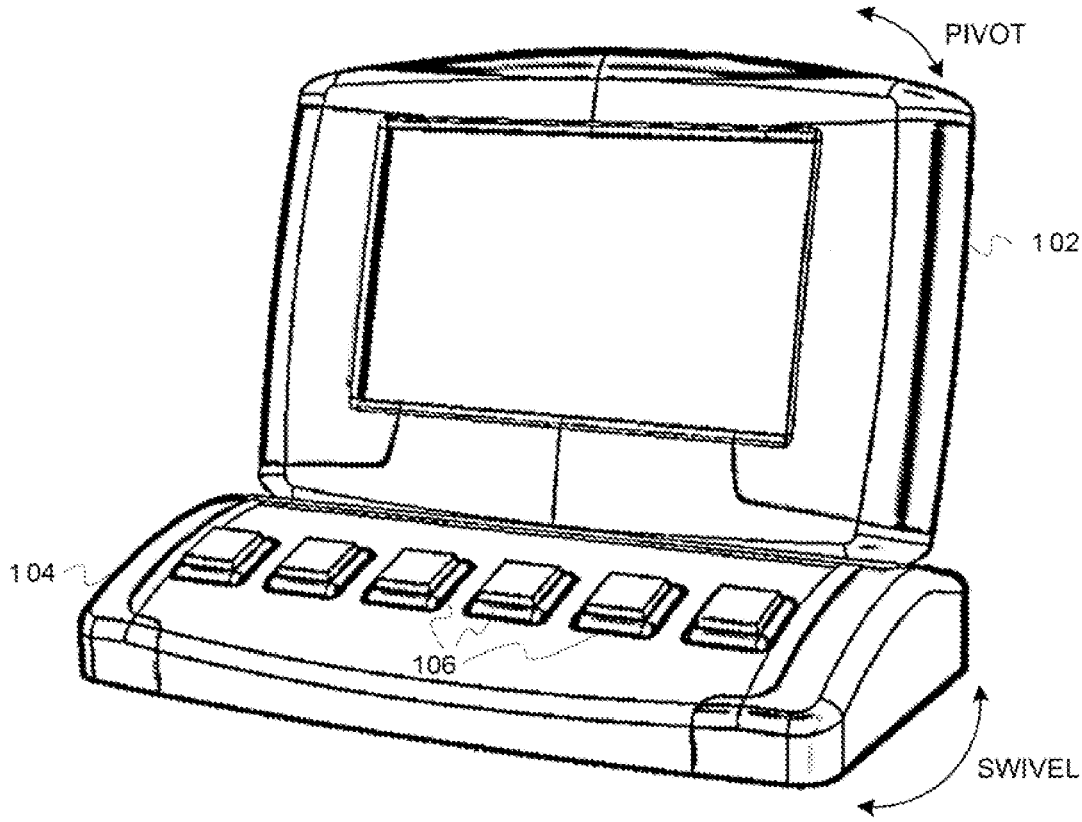
FIG. 1 illustrates a perspective view of a handheld wagering game machine and docking station, according to example embodiments of the invention.

FIG. 1 illustrates a perspective view of a handheld wagering game machine and docking station, according to example embodiments of the invention. The handheld wagering game machine ("handheld machine") 102 can operate in undocked and docked modes. In undocked mode, the handheld machine 102 can present wagering games, exchange content over networks, and perform other operations, while freely moving about. In docked mode (see FIG. 1), the handheld machine 102 connects to the docking station 104. In docked mode, the docking station 104 can provide power and data to the handheld machine 102 and it can hold the handheld machine 102 at different viewing positions. As shown, the docking station 104 includes buttons 106 for use by the handheld machine 102. The following section describes these and other features and embodiments.

Example Architectures

Handheld Wagering Game Machine Architecture

Figure 2:
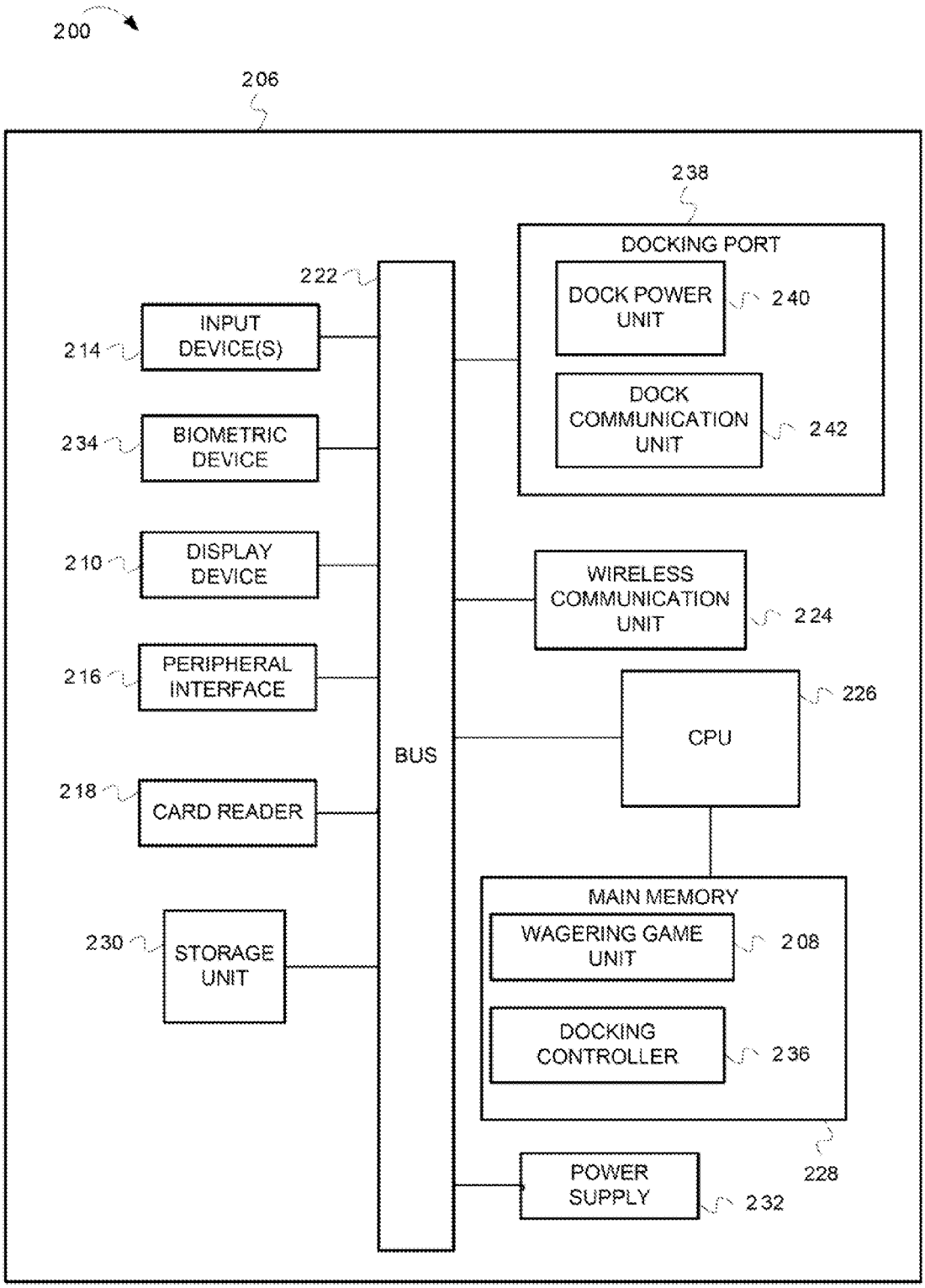
FIG. 2 is a block diagram illustrating a handheld wagering game device architecture, according to example embodiments of the invention.

FIG. 2 is a block diagram illustrating a handheld wagering game machine architecture, according to example embodiments of the invention. As shown in FIG. 2, the handheld machine 206 includes a bus 222, which is connected to a docking port 238. The docking port 238 includes a dock power unit 240 and a dock communication unit 242. The dock power unit 240 can include any suitable interface for receiving power from a docking station. For example, the dock power unit 240 can include surface-contact charging pad 1604*s*, pins, sockets, inductive charging components, etc. The dock communication unit 242 can include any suitable communication technology for transmitting and receiving wagering game content and non-wagering game content over a network via a docking station. For example, the dock communication unit 242 can include an IEEE 802.11G transceiver, infrared transceiver, Bluetooth transceiver, Ethernet transceiver, Universal Serial Bus transceiver, etc.

The bus 222 is connected to a central processing unit (CPU) 226, which is connected to a main memory 228. The main memory 228 can include a wagering game unit 208 that can present wagering games, such as video poker, video black jack, video slots, video lottery, etc. The main memory 228 can also include a docking controller 236 that can determine whether the handheld machine 206 is docked with a docking station. The docking controller 236 can detect when power and/or communications are received through the docking port 238. In one embodiment, if power and/or communications are received through the docking port 238, the docking controller 236 configures the handheld machine 206 to operate in docked mode. Otherwise the docking controller 236 can configure the handheld machine 206 to operate in undocked mode.

In one embodiment, when the handheld machine 206 is not docked, the docking controller 236 can take various measures to conserve power. For example, the docking controller 236 can restrict graphics to low power, low resolution configurations. The docking controller 236 can also reduce or eliminate sound and other features. However, when the handheld machine 206 is docked, the docking controller 236 can configure the handheld machine to draw power from through the dock power unit 240, operate in a high-power mode, utilize content received through the dock communication unit 242, and utilize peripheral devices addressable through the dock communication unit 242. Other embodiments can perform additional configuration operations.

The bus 222 is connected to a wireless communication unit 224, which includes logic for communicating to wireless access points and/or other external systems. In some embodiments, the wireless communication unit 224 transmits an RF signal to a signal authentication system (not shown). The signal authentication system can use the RF signal to authenticate the handheld machine 206 by comparing the RF signal with a previously recorded RF signal from the handheld machine 206. If the RF signal matches the recorded RF signal, the signal authentication system can allow the handheld machine 206 to access the network. In some embodiments, the signal authentication system records an RF signal when the handheld machine 206 first connects to the network. The signal authentication system can use the recorded signal to authenticate the handheld machine 206 during subsequent attempts to access the network. In some embodiments, the signal authentication system recalibrates the recorded RF signal to the handheld machine's RF signal to account for factors such as mobility and ambient temperature. In some embodiments, the signal authentication system can use a combination of the handheld machine's MAC address and its RF signal to authenticate the handheld machine.

The bus 222 is also connected to an input device(s) 214 (e.g., buttons, pointing device, etc.), biometric device 234, display device 210, peripheral interface(s) 216 (e.g., Universal Serial Bus ports, video ports, etc.), card reader 218, storage unit 230 (e.g., hard disk drive, semi-conductor memory mass storage device, etc.), and power supply 232. The power supply 232 can include a rechargeable battery, such as a nickel cadmium battery.

In some embodiments, the biometric device 234 can include an iris scanner (e.g., a digital camera) that captures images of users' irises and compares them against trusted images stored locally or in a remote database. In some embodiments, the iris scanner can be a BM-ET500 from Panasonic Corporation of North America, an IrisCam from Iritech Inc, or any other suitable iris scanner. In some embodiments, the biometric device 234 can include logic for performing facial recognition as part of a user authentication process.

The biometric device 234 can be utilized for more than just authenticating users. In some embodiments, the biometric device 234 can include logic for tracking players based on iris or facial recognition. For example, the biometric device 234 can determine that a particular player is using the handheld machine 206 and prompt a tracking system to record player activities and game session information (e.g., games played, wagers made, denominations used, start time, end time, frequency of use, etc.). In some embodiments, the tracking system does not store any personal information, such as names, addresses, etc. In some embodiments, the tracking system could recognize players and ask them about their experience. In some embodiments, the tracking system can be used to perform market analysis and to devise new products that appeal to players.

In some embodiments, the handheld machine 206 can include additional peripheral devices and/or more than one of each component shown in FIG. 2. For example, in one embodiment, the handheld machine 206 can include multiple wireless communication units 224 and multiple CPUs 226. In one embodiment, any of the components can be combined or divided. Additionally, in one embodiment, the components of the handheld machine 206 can be interconnected according to any suitable interconnection architecture (e.g., bus architecture, directly connected, hypercube, etc.).

In one embodiment, any of the components of the handheld machine 206 (e.g., the wagering game unit 208) can include hardware, firmware, and/or software for performing the operations described herein. In one embodiment, any of the handheld machine's components (e.g., the wagering game unit 208) can be embodied as instructions stored on a machine-readable medium, where the instructions are executable on the CPU 226 or other hardware. Machine-readable media can include any mechanism that provides (i.e., stores and/or transmits) information in a form readable by a machine (e.g., a handheld wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Docking Station Architecture

Figure 3:
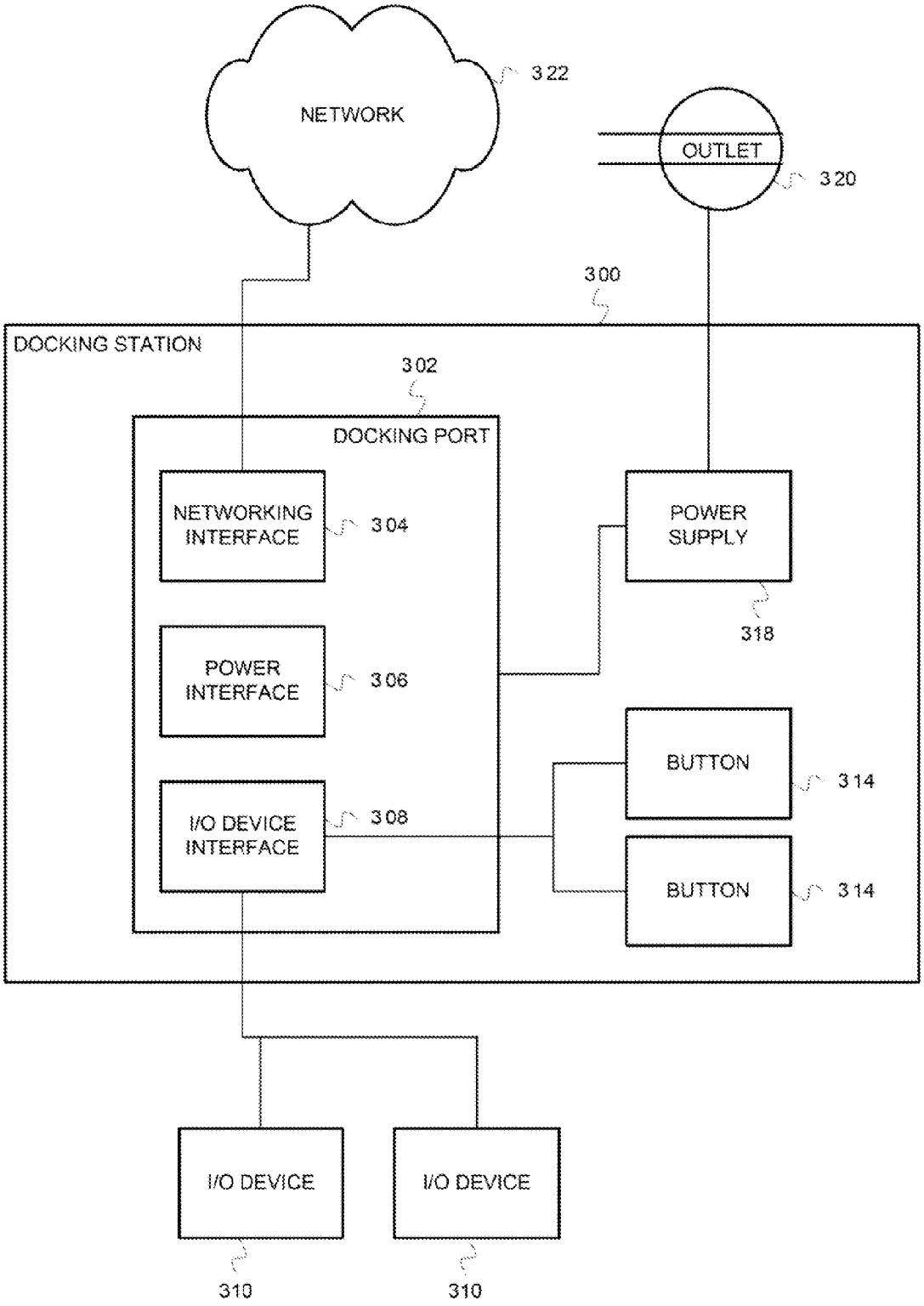
FIG. 3 is a block diagram illustrating a docking station architecture, according to example embodiments of the invention.

FIG. 3 is a block diagram illustrating a docking station architecture, according to example embodiments of the invention. In FIG. 3, the docking station 300 includes a docking port 302, power supply 318, and buttons 314. The docking port 302 includes a network interface 304, which is connected to a network 322. The network interface 304 can connect a handheld machine to the network 322. The docking port's power interface 306 can provide power to a handheld machine. In some embodiments, the power interface 306 receives power from the power supply 318, which draws the power from the wall outlet 320 or other suitable power source. The docking port's Input/Output (I/O) device interface 308 is connected to the buttons 314 and I/O devices 310 (e.g., a ticket printer). The I/O device interface 308 can transmit input originating at the buttons 314 and I/O devices 310 to a handheld machine. In some embodiments, the I/O device interface 308 can connect the I/O devices 310 and/or buttons 314 to a handheld machine via a USB connection.

Example Embodiments

This section describes different features that are available in different embodiments of the handheld machine and docking station.

Handheld Wagering Game Machine

Figure 4A:
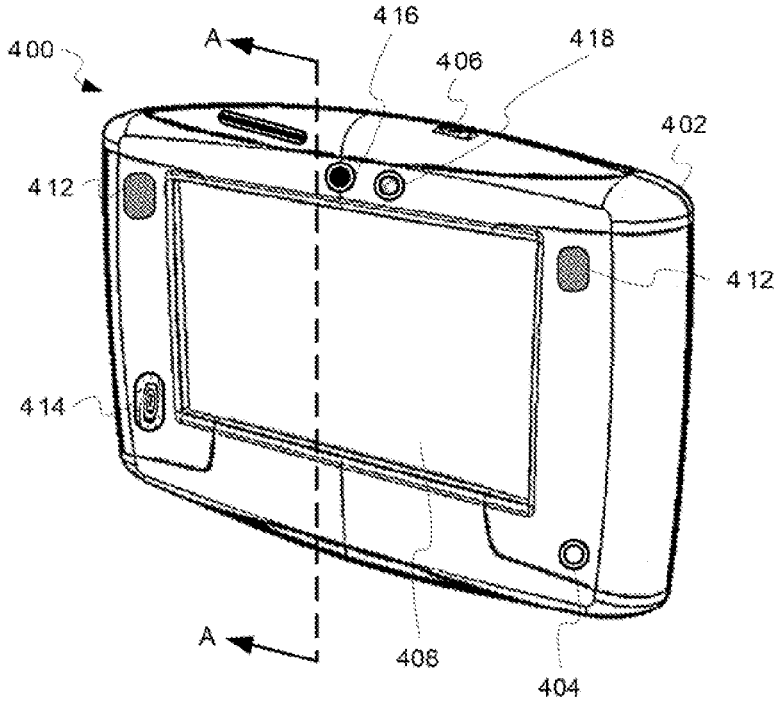
FIG. 4A is a perspective front-side view of a handheld wagering game machine, according to example embodiments of the invention.

FIG. 4A is a perspective front-side view of a handheld wagering game machine, according to example embodiments of the invention.

As shown, the handheld machine 400 includes an enclosure 402 that contains electronic and software components (e.g., see FIG. 2) and provides a form factor for the handheld machine 400. The handheld machine 400 also includes a touchscreen 408, speakers 412, and a power switch 406. Some embodiments of the handheld machine 400 include rubber grips, which can run from the right and left sides of the touchscreen 408 to the backside of the handheld machine 400.

The handheld machine 400 can present wagering games, such as video roulette, video black jack, video poker, and video slots, keno, etc. In some embodiments, the handheld machine 400 can exchange wagering game content and other information over a network. Thus, in some embodiments, the handheld machine 400 can interact with a network wagering game server (not shown), which may determine wagering game results. The handheld machine 400 can use the speakers 412 and touchscreen 408 to present media indicating wagering game results. For example, for a video slots game, the handheld machine 400 can show spinning reels to present the results to a player. As shown in 4A, the handheld machine 400 can include an audio jack up 404, biometric device 414 (e.g., a fingerprint reader), microphone 418, and camera 416. This section continues with a discussion about other features of the handheld machine 400.

Figure 4B:
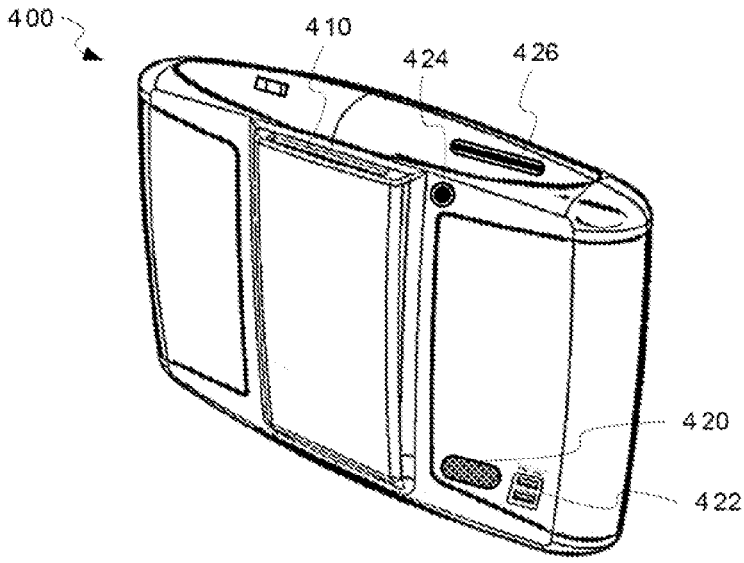
FIG. 4B is a perspective backside view of a handheld wagering game machine, according to example embodiments of the invention.

FIG. 4B is a perspective backside view of a handheld wagering game machine, according to example embodiments of the invention. As shown in FIG. 4B, the handheld machine 400 can include a card reader 410. In some embodiments, the card reader 410 can read from and write to player cards associated with casino player clubs, cashless gaming systems, player tracking systems, etc. The player information can be stored on the player cards and/or in player accounts on a server. The player cards can include magnetic stripe cards, smart cards, RFID cards, and similar devices. In some embodiments, the card reader 410 can include logic for reading other devices (e.g., memory cards, etc.) Additionally, the handheld machine 400 can include USB ports 422, an infrared transceiver 420, a memory card reader 426, and another camera 424.

Figure 5:
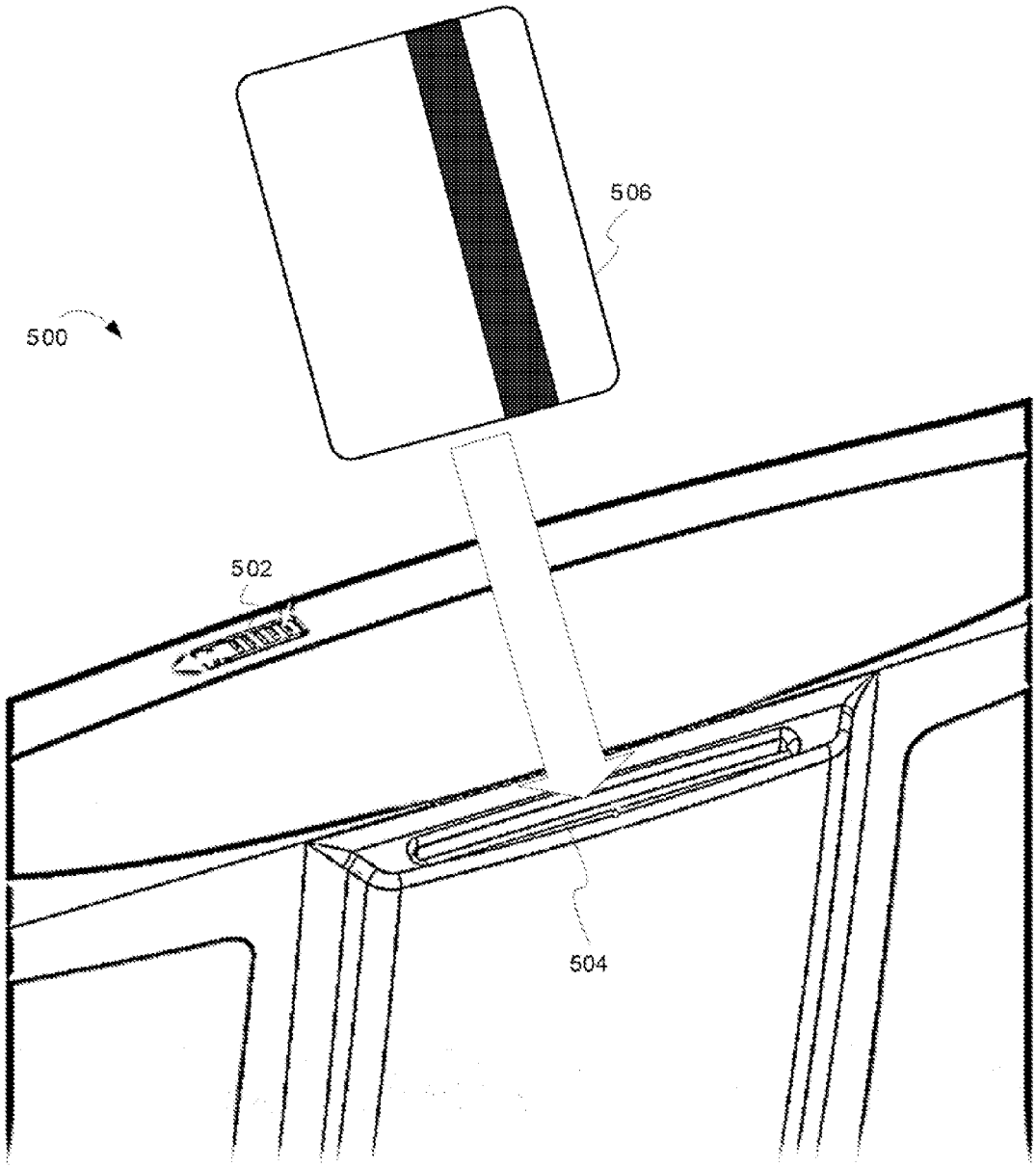
FIG. 5 shows a closer view of the handheld wagering game machine's card reader and power switch, according to example embodiments of the invention.

FIG. 5 shows a closer view of the handheld machine's card reader and power switch, according to example embodiments of the invention. As shown, the player card 506 can slide into the card reader 504. In some embodiments, when the player card 506 slides into the card reader 504, part of the player card 506 remains outside the card reader 504. In other embodiments, card reader 504 can contain the entire player card 506.

In some embodiments, the player card 506 can include a biometric authentication device that authenticates a player. The player card's biometric authentication device can biometrically authenticate a player and then exchange authentication information with the handheld machine 500. Some wagering game systems use the player cards to track player-related information, periodically authenticate players, perform cashless gaming operations, etc. Thus, in some embodiments, the handheld machine 500 requires that a player card 506 be in the card reader 504 when presenting wagering games. If the player card 506 is removed, the handheld machine 500 can halt wagering games, zero-out the credit meter, and hold the remaining credits in an accounting system. In other embodiments, a player card 506 is not needed for presenting wagering games.

As shown, the power switch includes a slidable switch actuator 502, which enables players to switch the handheld machine's power on and off. In some embodiments, the power switch includes a different actuation mechanism. For example, the handheld machine's power switch can include an actuator that requires a tool (e.g., a stylus, screw driver, etc.) to switch power on and off.

This section continues with a discussion of features that enable embodiments of the handheld machine to dock with docking stations.

Figure 6:
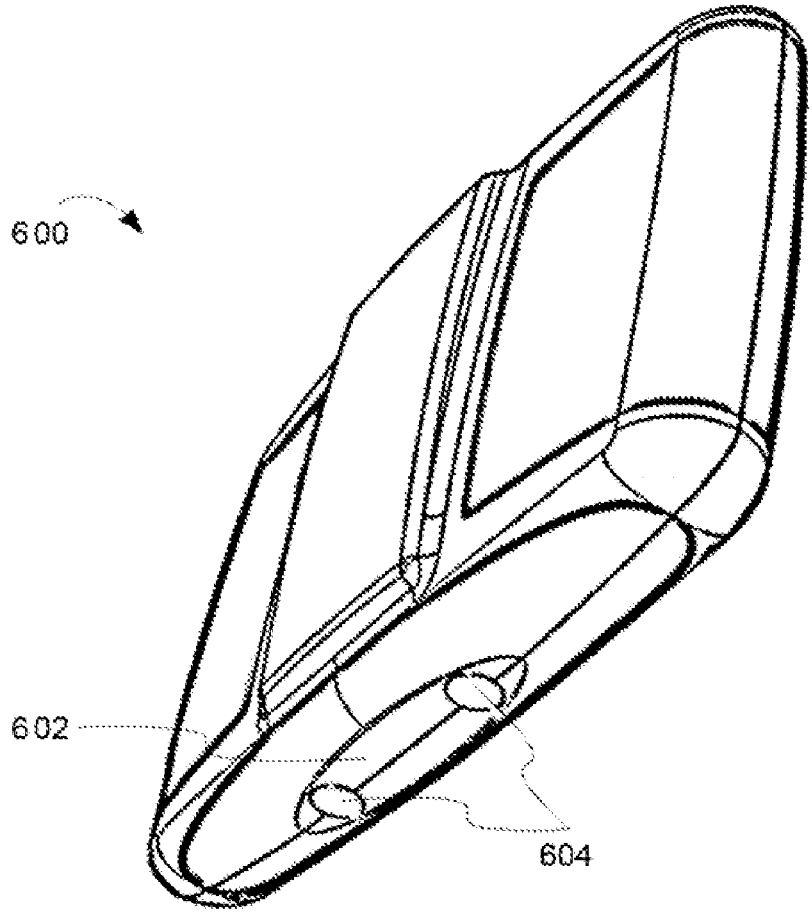
FIG. 6 illustrates a perspective view showing docking components of a handheld wagering game machine, according to example embodiments of the invention.

FIG. 6 illustrates a perspective view showing docking components of a handheld wagering game machine, according to example embodiments of the invention. As shown, the handheld machine 600 includes a docking port 602. In some embodiments, the docking port 602 includes components for receiving power, exchanging data, and mechanically connecting the handheld machine 602 to a docking station (not shown in FIG. 6). As shown, the docking port 602 includes connectors 604. The connectors 604 can include pins, sockets, contact pads, or any other suitable component for establishing electrical and data connections with a docking station. Additionally, the connectors 604 can include support members, latches, flanges, and other mechanical components for connecting the handheld machine 602 to a docking station.

Figure 7A:
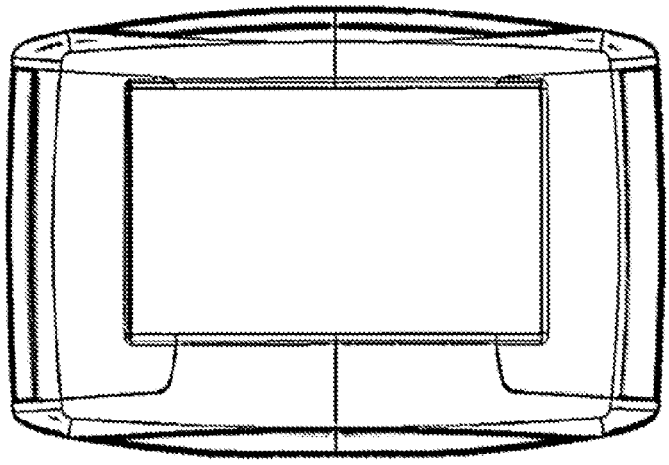
FIG. 7A illustrates a front view of some embodiments of the handheld wagering game machine.
Figure 7B:
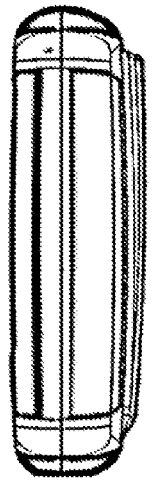
FIG. 7B illustrates a side view of some embodiments of the handheld wagering game machine.
Figure 7C:
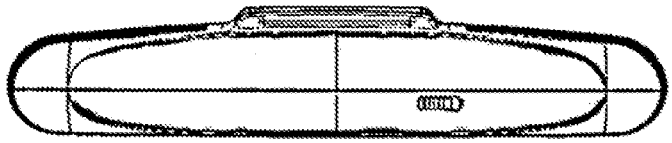
FIG. 7C illustrates a top view of some embodiments of the handheld wagering game machine.
Figure 7D:
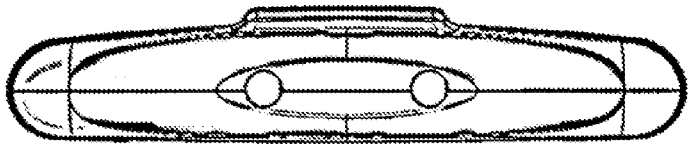
FIG. 7D illustrates a bottom view of some embodiments of the handheld wagering game machine.

FIGS. 7A-7D show additional views of embodiments of the handheld machine. FIG. 7A illustrates a front view of some embodiments of the handheld wagering game machine. FIG. 7B illustrates a side view of some embodiments of the handheld wagering game machine. FIG. 7C illustrates a top view of some embodiments of the handheld wagering game machine. FIG. 7D illustrates a bottom view of some embodiments of the handheld wagering game machine.

Docking Station

This discussion continues with a description of embodiments of a docking station.

Figure 8A:
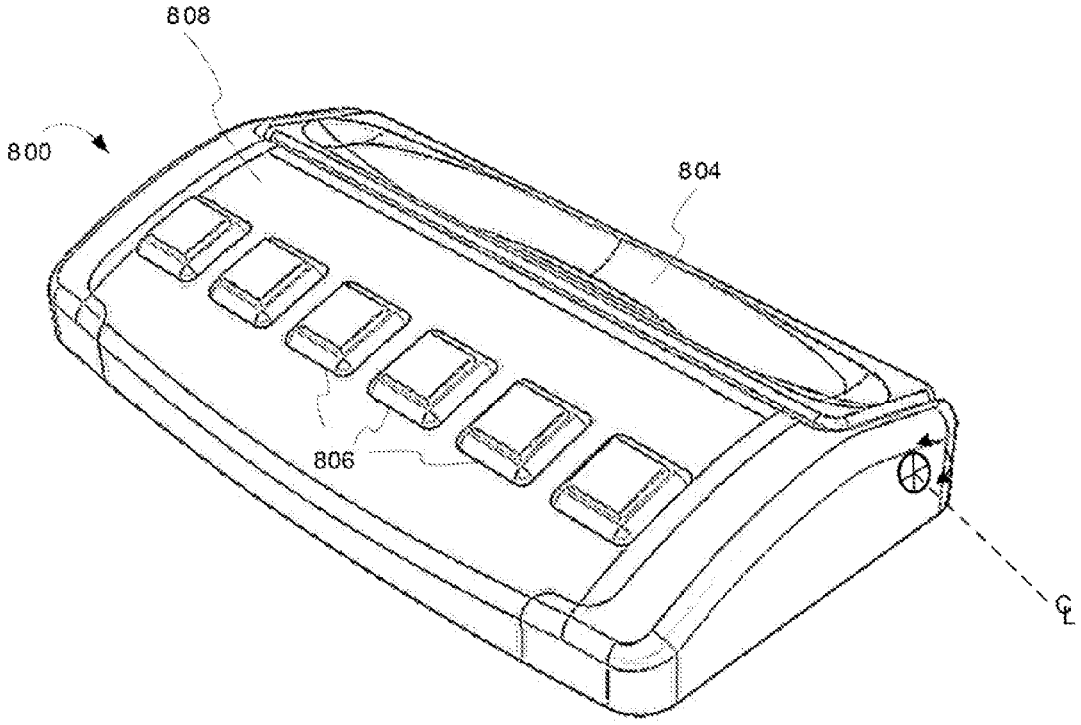
FIG. 8A illustrates a perspective view of a docking station, according to example embodiments of the invention.
Figure 8B:
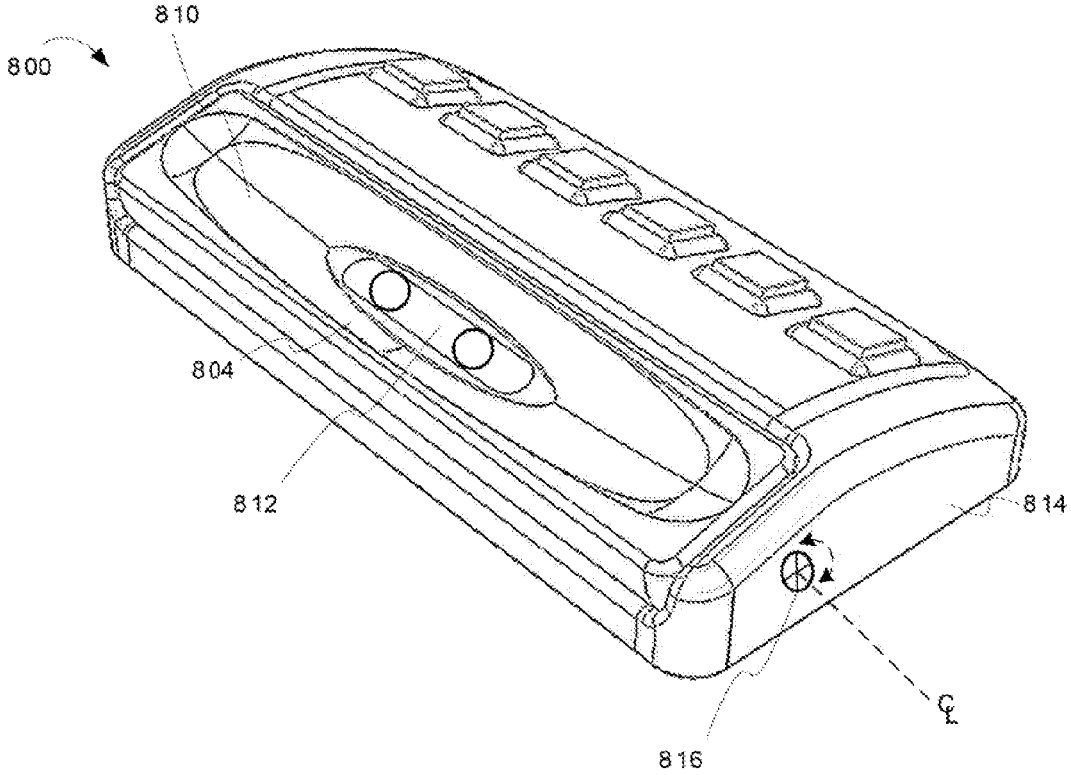
FIG. 8B illustrates another view of the docking station, according to example embodiments of the invention.

FIG. 8A illustrates a perspective view of a docking station, according to example embodiments of the invention. In FIG. 8A, the docking station 800 includes a button panel 808, which includes a plurality of buttons 806. While FIG. 8A shows an embodiment with six buttons, other embodiments can have any number of buttons. In some embodiments, the buttons 806 can include organic light emitting diodes (OLEDs), liquid crystal displays, or other display devices, which can present button legends, animations, and theme-specific graphical content. The buttons 806 can receive graphical content from a handheld machine, network connection, or other suitable source. The docking station 800 also includes a docking port 804 for receiving a handheld machine (not shown in FIG. 8A). FIG. 8B shows more details of the docking port 804.

FIG. 8B illustrates another view of the docking station, according to example embodiments of the invention. In FIG. 8B, the docking port 804 includes a connection cylinder 810 and a connector 812. The connection cylinder 810 can receive a handheld machine and hold it in contact with the connector 812. In some embodiments, the connection cylinder 810 includes support members 816, which plug into in the main body 814. In other embodiments, the connection cylinder 810 includes a spring-loaded ball plunger on each end, where the plungers plug into dimples in the main body 814. Other embodiments use other components, such as hinges, bearings, etc. The connection cylinder 810 can pivot about its mounting points (e.g., the support members 816, plungers, etc.), enabling the docking station 800 to hold a handheld machine at different viewing angles. In some embodiments, the connection cylinder 810 can lock into preset positions.

The connector 812 can include pins, sockets, contact pads, or any other components suitable for establishing electrical and data connections with a handheld machine. In some embodiments, the connector 812 includes a networking interface, power interface, and I/O device interface (see discussion of FIG. 2). Additionally, the connector 812 can include support members, latches, flanges, and other mechanical components for supporting a handheld machine.

Figure 9:
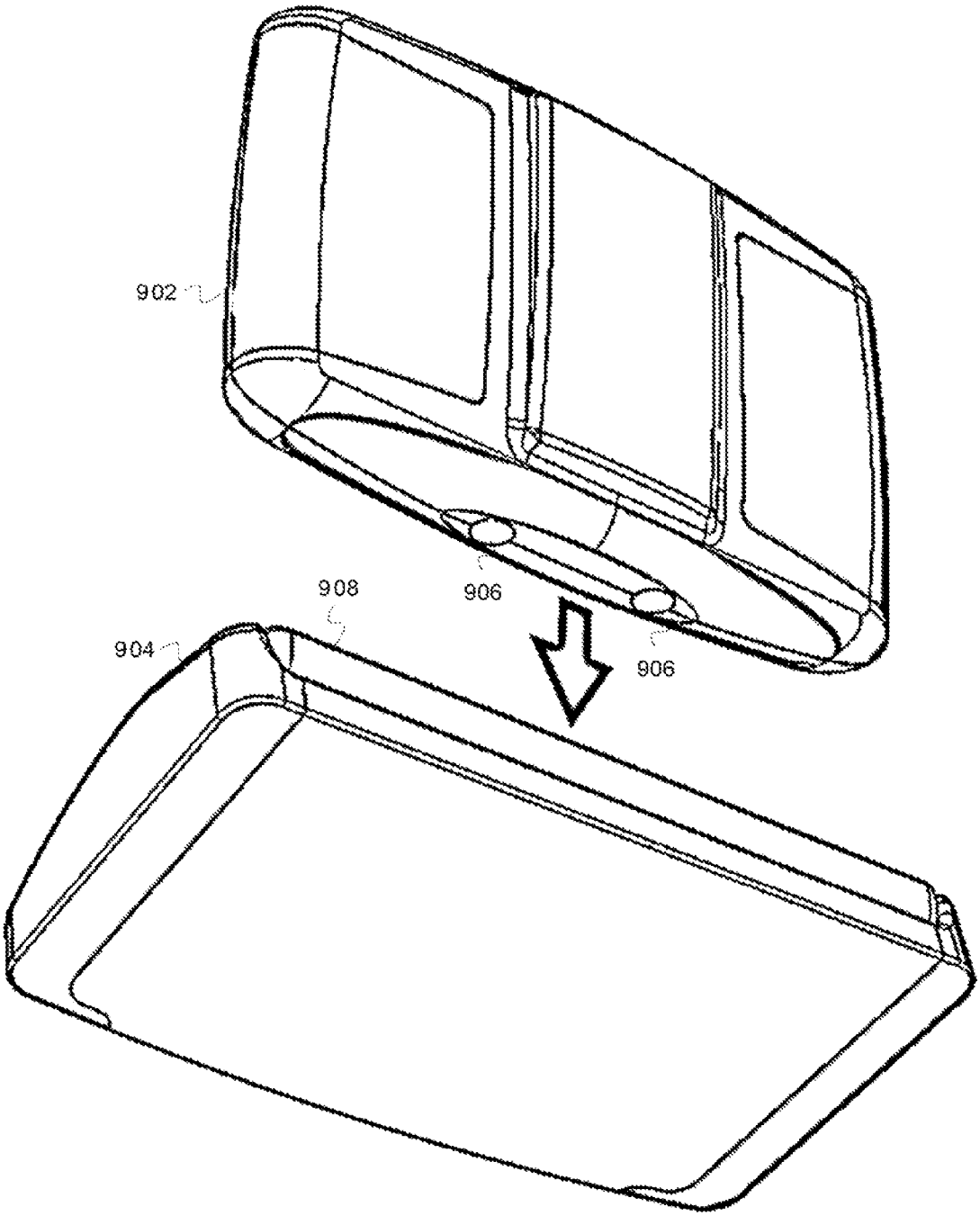
FIG. 9 illustrates a perspective view of a handheld wagering game machine docking with a docking station, according to example embodiments of the invention.
Figure 10:
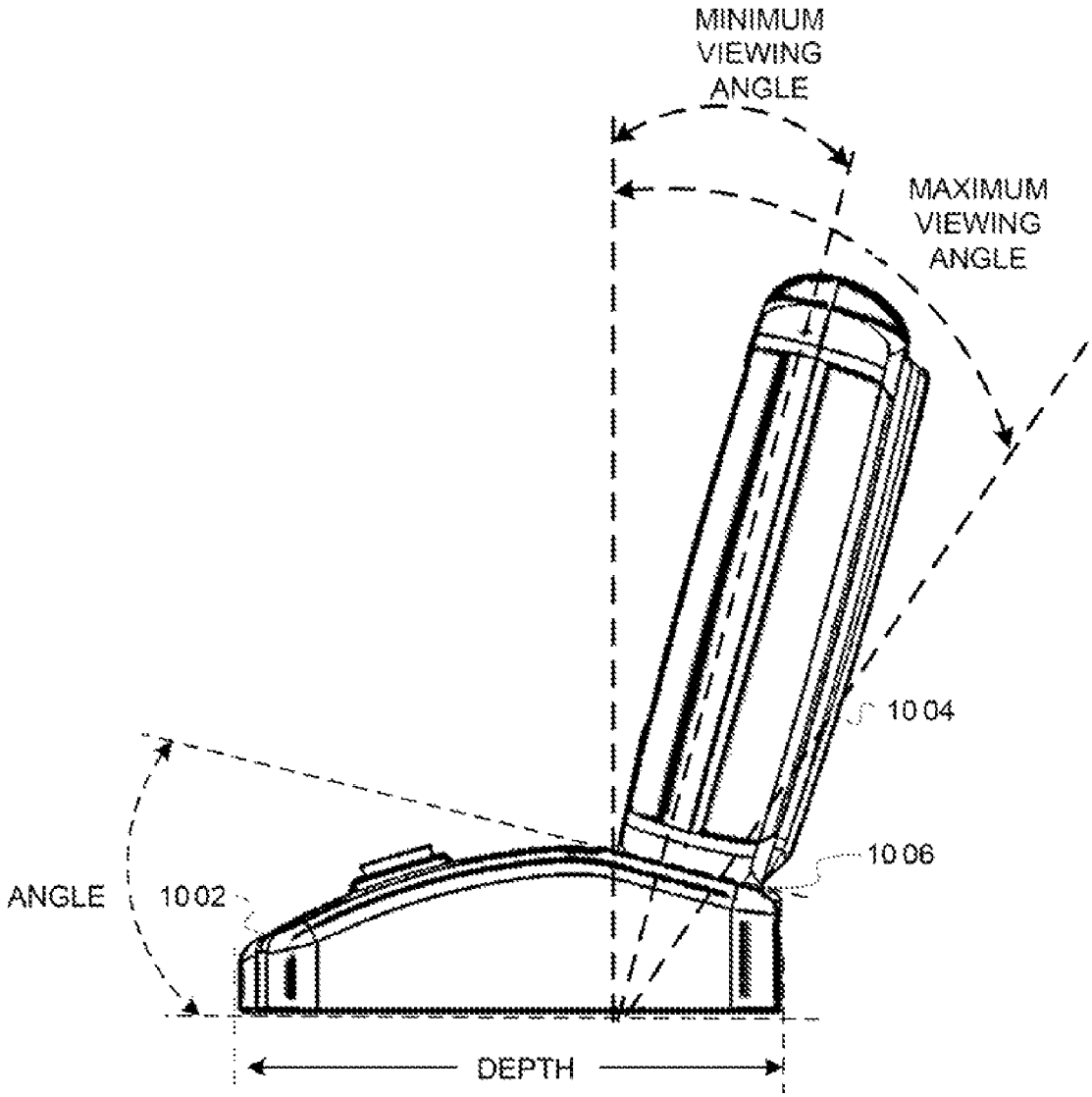
FIG. 10 shows how a docking station can hold a handheld wagering game machine at different viewing angles, according to example embodiments of the invention.

FIG. 9 illustrates a perspective view of a handheld wagering game machine docking with a docking station, according to example embodiments of the invention. The handheld machine 902 can be inserted into the docking station's docking port 908. Upon insertion, the handheld machine's connectors 906 can connect with the docking station's connectors (see FIG. 8B), establishing electrical and data connections between the devices. Furthermore, upon insertion, the docking station 904 can hold the handheld machine 902 in an upright position. FIG. 10 show how embodiments of the docking station can hold the handheld machine in different up-right positions.

FIG. 10 shows how a docking station can hold a handheld wagering game machine at different viewing angles, according to example embodiments of the invention. As shown, the handheld machine 1004 is docked with the docking station 1002. In some embodiments, the docking station 1002 can hold the handheld machine 1004 at different viewing angles. For example, the handheld machine 1004 can pivot between a minimum viewing angle and maximum viewing angle. In one embodiment, the minimum viewing angle is 15° and the maximum viewing angle is 30°. In other embodiments, the minimum and maximum viewing angles are different. The viewing angle can be adjusted to minimize screen glare and accommodate user preferences. In some embodiments, the docking station 1002 enables the handheld machine 1004 to pivot between preset viewing angles. For example, the handheld machine 1004 can pivot between viewing angles, 15°, 20°, 25°, and 30°.

In some embodiments, the docking station 1002 is contoured such that the outer surface of the docking port 1006 is set at angle (e.g., 15°). In some embodiments, the angle is 15°, whereas the angle differs in other embodiments. In some embodiments, the depth of the docking station is 5.38 inches. In other embodiments, the depth can be different.

Mounting Features

The docking station can be mounted on bar tops, table tops, and other surfaces. FIGS. 11A-12D show components for mounting a docking station and positioning it about a mounting surface.

Figure 11A:
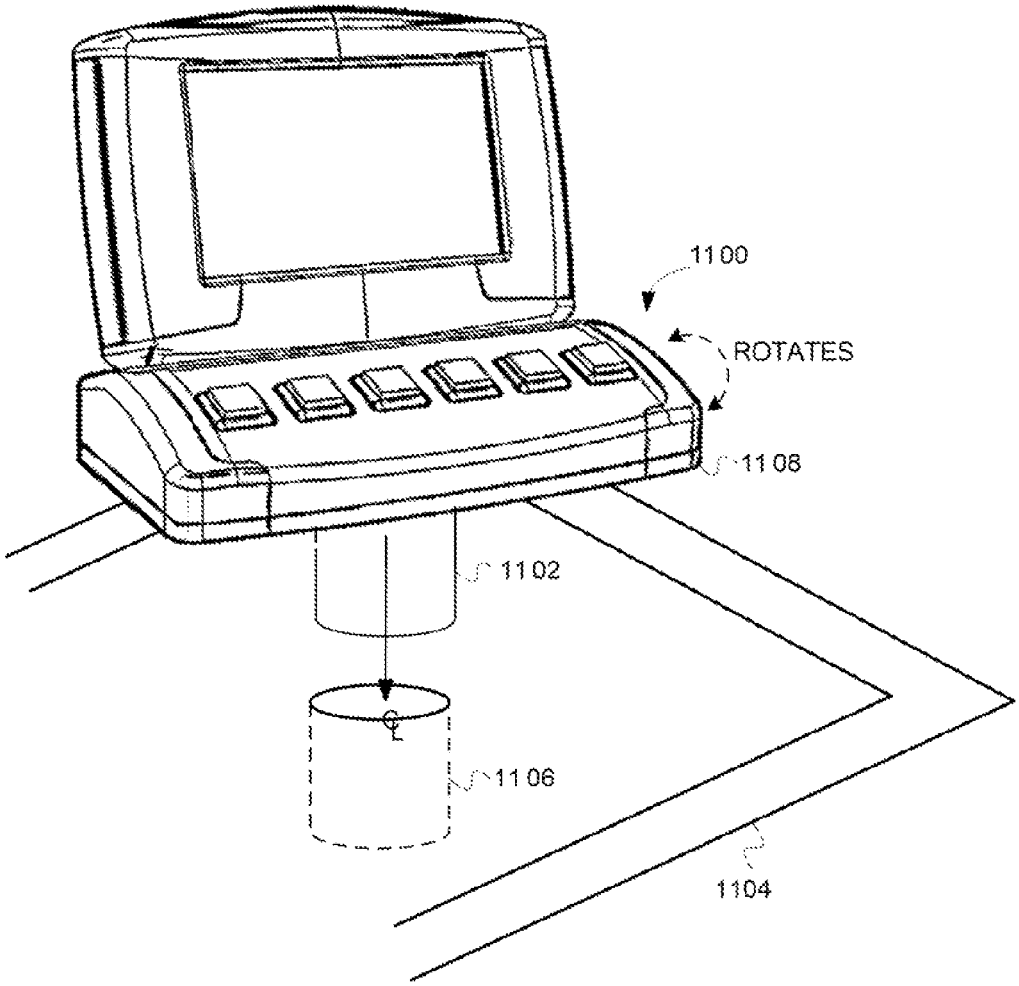
FIG. 11A is a perspective view showing how some embodiments of the docking station can mount on bar tops and other surfaces, according to example embodiments of the invention.

FIG. 11A is a perspective view showing how some embodiments of the docking station can mount on bar tops and other surfaces, according to example embodiments of the invention. As shown, the docking station 1100 includes a mounting member 1102, while the bar top 1104 includes a mounting socket 1106. The mounting socket 1106 can be fastened to the underside of the bar top 1104. If the docking station 1100 is not present on the bar top 1104, a cap can be placed flush in the mounting socket 1106. The docking station 1100 can be mounted to the bar top 1104 by inserting the mounting member 1102 into the mounting socket 1106. In some embodiments, the mounting member 1102 and mounting socket 1106 fasten together. For example, the mounting member 1102 and mounting socket 1106 can snap together with a flange-and-latch-type coupling (not shown) or other suitable coupling. In some embodiments, the members 1102 & 1106 lock together, securing the docking station 1100 against unauthorized removal.

In some embodiments, after the docking station 1100 is mounted on the bar top 1104, the docking station 1100 swivels about the mounting member 1102 and/or the mounting socket 1106. Because the docking station 1100 can swivel, players can use it from different sides of the bar top 1104.

Some embodiments of the docking station occupy substantially smaller spaces than conventional bar top wagering game machines. In some embodiments, the docking station can be mounted in different surface top configurations.

Figure 11B:
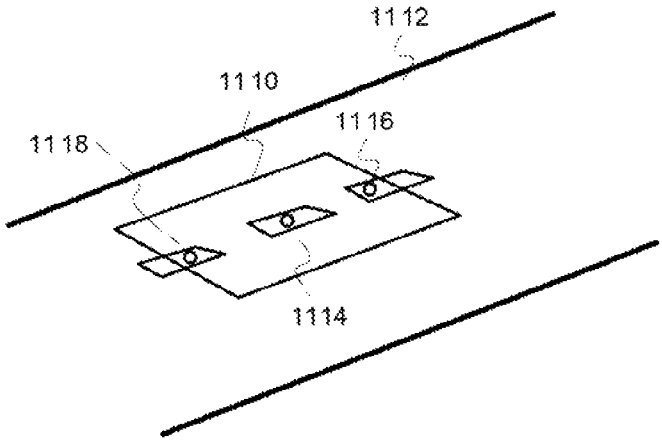
FIG. 11B is a block diagram illustrating how docking stations can be positioned on bar tops or other surfaces, according to example embodiments of the invention.

FIG. 11B is a block diagram illustrating how docking stations can be positioned on bar tops or other surfaces, according to example embodiments of the invention. In FIG. 11B, the area 1110 shows a footprint for a conventional bar top wagering game machine. The area 1110 includes three mounting sockets 1114, 1116, & 1118. Docking stations can be mounted in mounting sockets 1114 and 1116 to offer a greater concentration of gaming machines per square foot of bar space, while avoiding overcrowding. As shown, two docking stations can fit in approximately the same area occupied by one conventional bar top wagering game machine. A single docking station mounted at any of the sockets 1114, 1116, & 1118 occupies substantially less bar top space than a conventional bar top wagering game machine. During busy times, a bar owner can mount more docking stations on the bar top 1112. However, during slower times, the bar own can remove the docking stations and cap the sockets, leaving a flat bar top for serving food and drink.

This section continues with a discussion of additional components for mounting docking stations to bar tops and other surfaces.

Figure 12A:
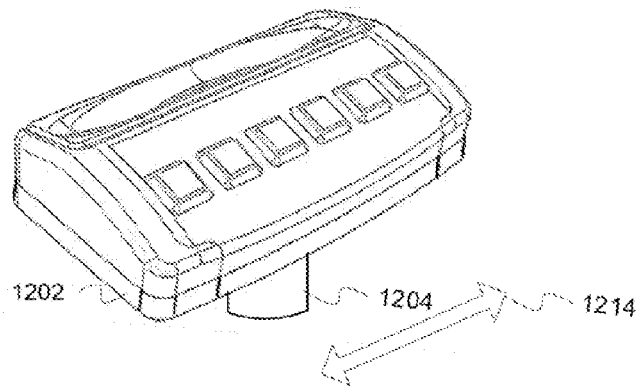
FIG. 12A is a perspective view of a docking station including mounting components, according to example embodiments of the invention.
Figure 12B:
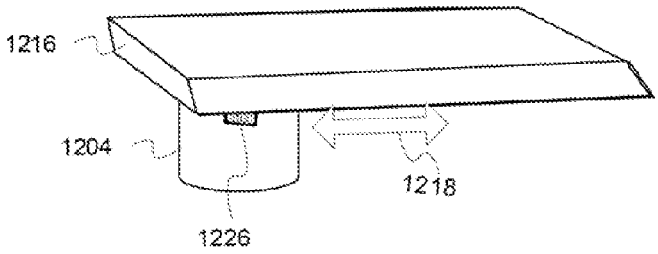
FIG. 12B is a perspective view of certain mounting components of a docking station, according to example embodiments of the invention.

FIG. 12A is a perspective view of a docking station including mounting components, according to example embodiments of the invention. In FIG. 12A, a docking station 1202 includes a mounting member 1204. In some embodiments, the mounting member 1204 is slidably adjustable, as indicated by the arrow 1214. FIG. 12B shows additional details about some embodiments of the slidable mounting member.

FIG. 12B is a perspective view of certain mounting components of a docking station, according to example embodiments of the invention. In FIG. 12B, the mounting member 1204 is connected to a support member 1216. The support member 1216 can be disposed inside the docking station's main body. In some embodiments, the mounting member 1204 is slidably adjustable (indicated by the arrow 1218). In some embodiments, the mounting member 1204 slides by pressing the button 1226, which releases a latch, clamp, or other mechanism for holding the mounting member 1204 in place. As a result, a docking station can reposition its footprint after being mounted on a bar top.

Figure 12C:
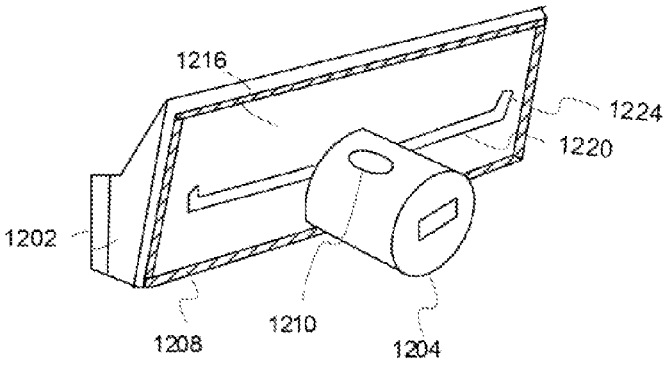
FIG. 12C is a perspective bottom side view showing mounting components of a docking station, according to example embodiments of the invention.

FIG. 12C is a perspective bottom-side view showing mounting components of a docking station, according to example embodiments of the invention. In FIG. 12C, the support member 1216 is disposed inside the main body of the docking station 1202. The support member 1216 includes a groove 1220 in which the mounting member 1204 can slide. The mounting member 1204 can move to and hold fast at any position in the groove 1220. The groove 1220 can include notches 1224 for positioning the mounting member 1204 at predetermined locations in the groove 1220. In some embodiments, the mounting member 1204 is held in place by a spring loaded latch, which fits into the notches 1224.

In one embodiment, the support member 1204 can be part of the docking station's enclosure or main body. In such an embodiment, the enclosure of main body includes the groove 1220.

In FIG. 12C, the docking station 1202 includes a gasket 1208. The gasket 1208 can be made from any material suitable for preventing liquid and debris from traveling under the docking station 1202, offsetting uneven surfaces, absorbing vibration, and preventing damage to the mounting surface.

Figure 12D:
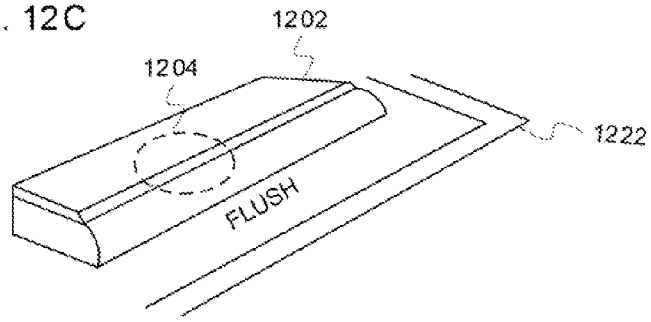
FIG. 12D is a perspective view showing a docking station mounted flush on a bar top, according to example embodiments of the invention.

FIG. 12D is a perspective view showing a docking station mounted flush on a bar top, according to example embodiments of the invention. As shown, the docking station 1202 is mounted flush to the bar top 1222. That is, the docking station 1202 is mounted snuggly against the bar top 1222, where there are no gaps between the docking station 1202 and the bar top 1222.

Enclosures

Figure 13:
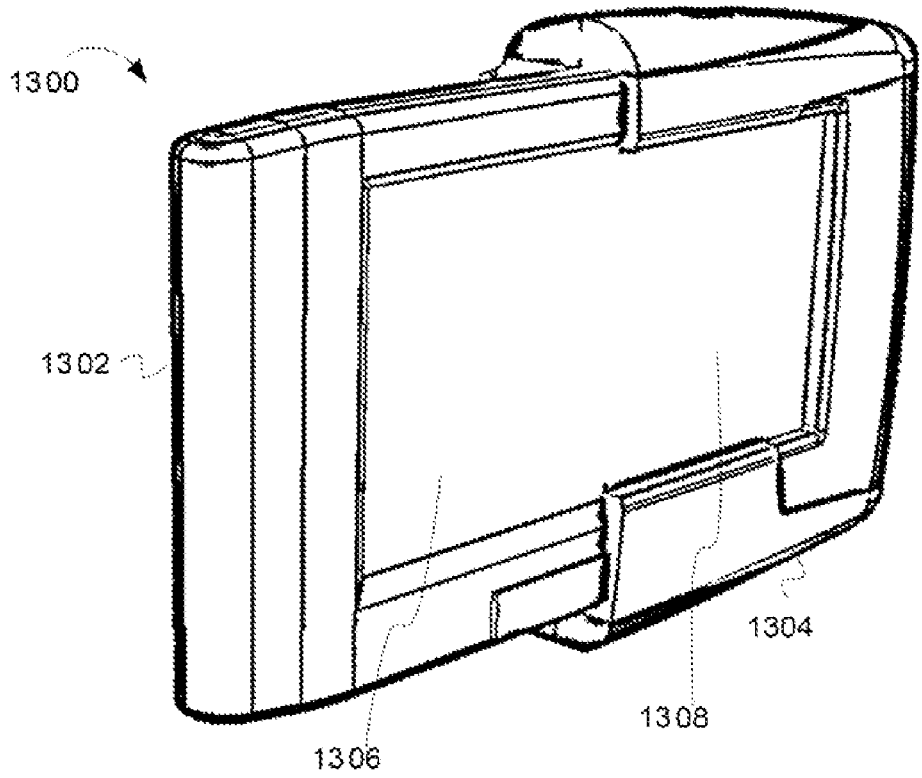
FIG. 13 is a perspective cutaway view showing primary and secondary enclosures of a handheld wagering game machine, according to example embodiments of the invention.

The discussion continues with a description of enclosures that can be used with embodiments of the handheld machine. FIGS. 13-15 show some features of the enclosures.

FIG. 13 is a perspective cutaway view showing primary and secondary enclosures of a handheld wagering game machine, according to example embodiments of the invention. In FIG. 13, the handheld machine 1300 includes a primary enclosure 1302 and a secondary enclosure 1304. The primary enclosure 1302 contains electronic and software components, such as circuit boards, hard disk drives, input/output devices, and a display device 1306. The secondary enclosure 1304 contains the primary enclosure 1302. As shown, the secondary enclosure 1304 includes a display opening 1308 through which the display device 1306 can be seen. The secondary enclosure 1302 can provide protection, such as liquid and shock resistance, to the primary enclosure and electronic and software components. Additionally, the secondary enclosure 1304 can provide improved ergonomics, as it can include enhanced padding, grips, handles, etc. In some embodiments, the handheld machine 1300 does not include the primary enclosure 1302. Instead, the secondary enclosure itself 1304 holds the circuit boards, hard disk drives, input/output devices, and a display device 1306. FIGS. 14A-D show other cutaway views of the handheld machine.

Figure 14A:
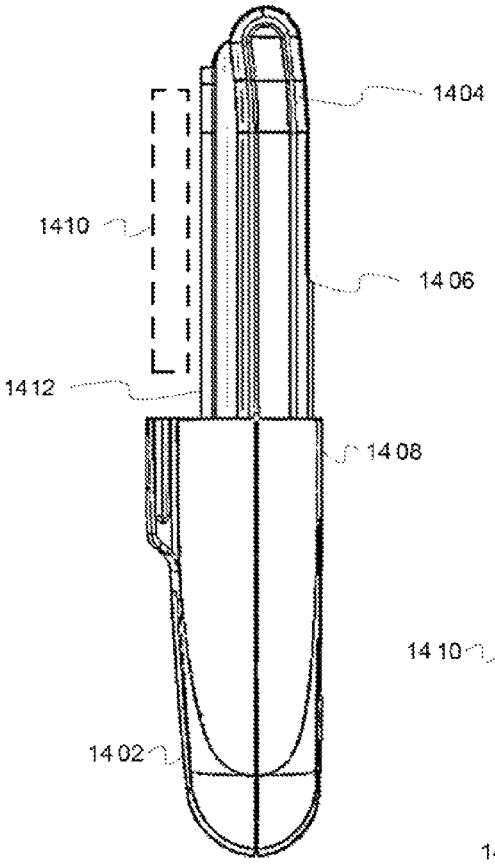
FIG. 14A is side cutaway view showing primary and secondary enclosures of a handheld wagering game machine, according to example embodiments of the invention.
Figure 15:
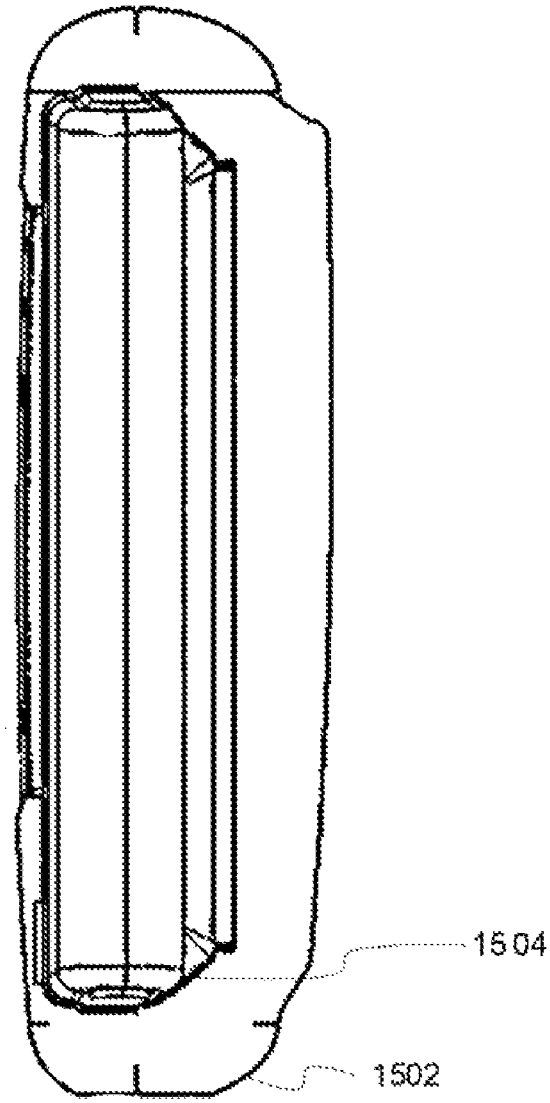
FIG. 15 is a sectional view of a handheld wagering game machine including primary and secondary enclosures, according to example embodiments of the invention.

FIG. 14A is cutaway side view showing primary and secondary enclosures of a handheld wagering game machine, according to example embodiments of the invention. In FIG. 14A, the primary enclosure 1404 fits inside the secondary enclosure 1402. As shown, the docking station's display device 1406 is flush with the secondary enclosure's display opening 1408. However, there is space 1410 between the primary enclosure's backside 1412 and the secondary enclosure 1402. In some embodiments, the space between the enclosures can accommodate peripheral devices and other electronics, such as a card reader, processor interface circuit board, cables, and/or wires.

Figure 14D:
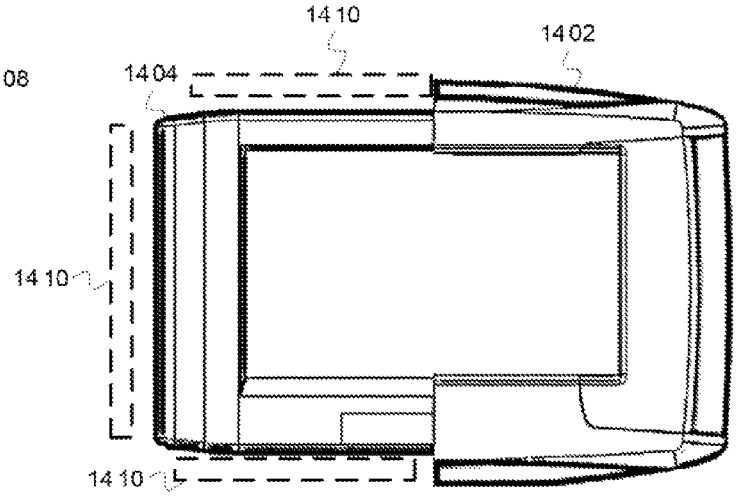
FIG. 14D is a front cutaway view showing primary and secondary enclosures of a handheld wagering game machine, according to example embodiments of the invention.
Figure 14B:
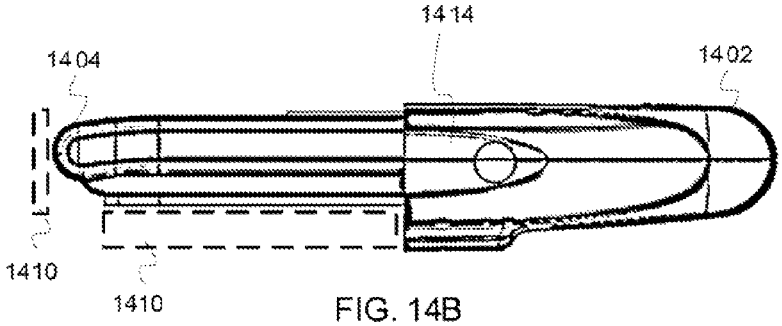
FIG. 14B is a bottom cutaway view showing primary and secondary enclosures of a handheld wagering game machine, according to example embodiments of the invention.
Figure 14C:
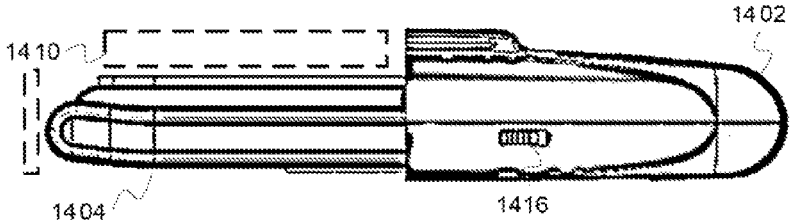
FIG. 14C is a top cutaway view showing primary and secondary enclosures of a handheld wagering game machine, according to example embodiments of the invention.

FIGS. 14B, 14C, & 14D show additional views of the handheld machine 1400. FIG. 14B is a bottom cutaway view showing primary and secondary enclosures of a handheld wagering game machine, according to example embodiments of the invention. In FIG. 14B, the secondary enclosure 1402 includes a cutout 1414 for the machine's docking port. In FIG. 14B, there is space 1410 between the primary and secondary enclosures 1404 & 1402. FIG. 14C is a cutaway top view showing primary and secondary enclosures of a handheld wagering game machine, according to example embodiments of the invention. FIG. 14C shows space 1410 between the primary and secondary enclosures 1404 and 1402. In FIG. 14C, the secondary enclosure 1402 includes a power switch coupling 1416 that connects to a power switch (not shown) mounted on the primary enclosure 1404. FIG. 14D is a front cutaway view showing primary and secondary enclosures of a handheld wagering game machine, according to example embodiments of the invention. FIG. 14D shows space 1410 between the primary and secondary enclosures 1404 and 1402.

FIG. 15 is a sectional view (see FIG. 4A) of a handheld wagering game machine including primary and secondary enclosures, according to example embodiments of the invention. In FIG. 15, the primary enclosure 1504 is disposed inside the secondary enclosure 1502. As shown, there is a space between the primary and secondary enclosures 1504& 1502 on the top, bottom, and back sides. In different embodiments, the amount of the space differs.

Charging Pads

Figure 16:
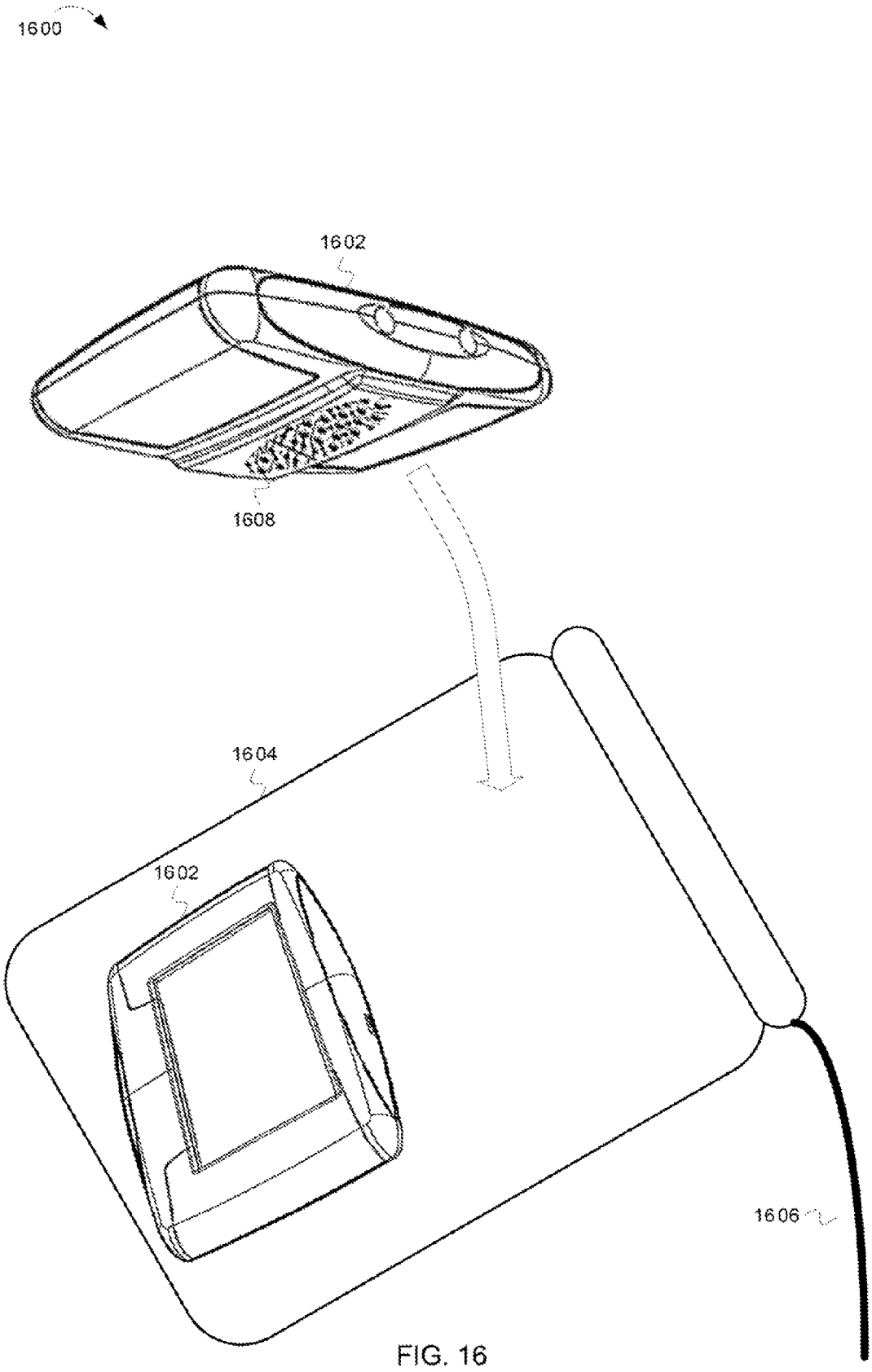
FIG. 16 is a perspective view of a charging pad system for use with handheld wagering game machines, according to example embodiments of the invention.

FIG. 16 is a perspective view of a charging pad system for use with handheld wagering game machines, according to example embodiments of the invention. As shown, the charging pad 1604 can be flat and thin with a conductive surface. In some embodiments, the charging pad 1604 includes inductive coils. Once a handheld wagering game machine 1602 is placed on the charging pad 1604 it can receive power from the charging pad 1604. In some embodiments, the wagering game machine 1602 can draw power from anywhere and at any orientation on the charging pad 1604. In some embodiments, the charging pad 1604 can charge the handheld wagering game machine 1602 at the same rate as a docking station. The charging pad 1604 can plug into a wall power outlet with its power cord 1606. Alternatively, the charging pad 1604 can be wired directly into a power source.

In some embodiments, the handheld wagering game machine 1602 can be outfitted with an adapter suited for receiving power from the charging pad 1604. In other embodiments, components for utilizing the charging pad 1604 can be native to the handheld wagering game machine

1602. Both adapters and native charging components can include external "bumps" (i.e., contact-surfaces 1608) that physically contact the charging pad 1604. The adapter or native charging components can include one or more coils (not shown) attached to a battery (not shown) of the handheld wagering game machine 1602.

Once the handheld wagering game machine is placed on the charging pad 1604, power is transferred from the charging pad's surface through the contact-surfaces 1608 into the handheld wagering game machine 1602. In some embodiments, the geometries of the charging pad 1604 and the contact-surfaces 1608 ensure that regardless of where the handheld wagering game machine 1602 is placed on the charging pad's surface, a closed electrical circuit is formed between the surface and the machine 1602. Such direct contact allows for a very efficient and safe power transfer without generating radiation or magnetic fields. The charging pad 1604 can be waterproof and suitable for use on bar tops. In some embodiments, the charging pad 1604 can charge a plurality of handheld wagering game machines.

Figure 17:
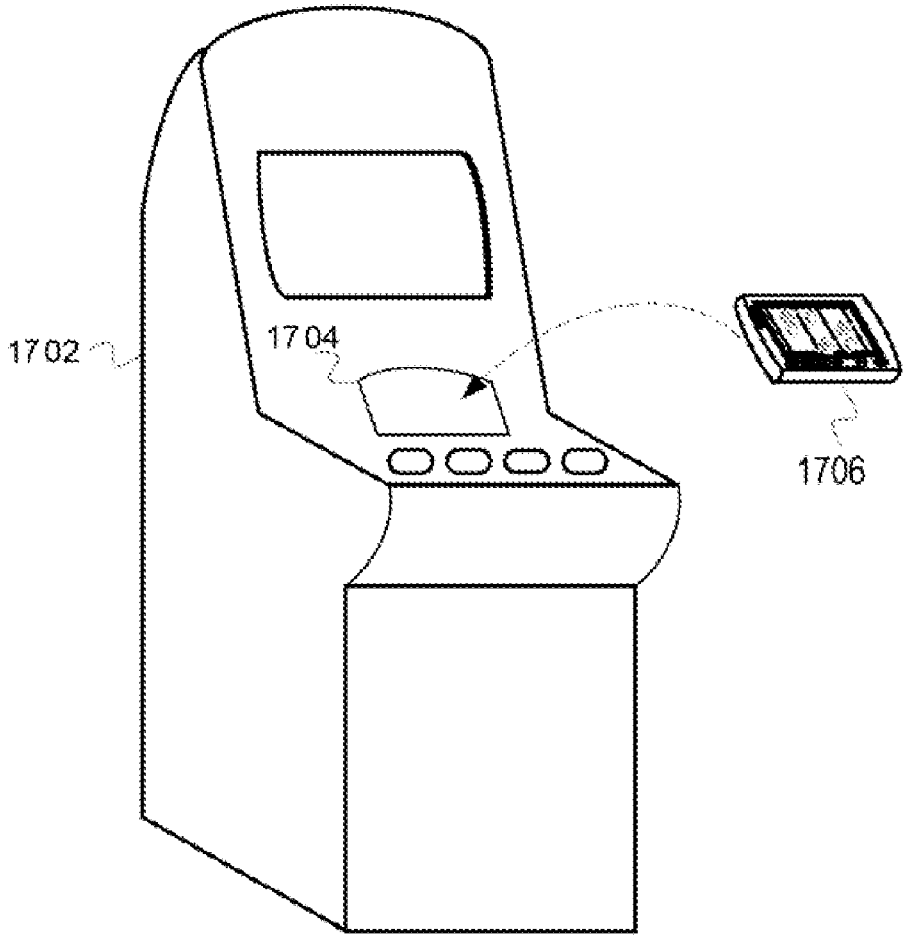
FIG. 17 illustrates a cabinet-style wagering game machine including a charging pad, according to some embodiments of the invention.

FIG. 17 illustrates a cabinet-style wagering game machine including a charging pad, according to some embodiments of the invention. As shown in FIG. 17, a charging pad 1704 can be located on a cabinet-style wagering game machine 1702. The handheld wagering game machine 1706 can recharge using the charging pad 1704. In some embodiments, devices other than handheld wagering game machines can be adapted to receive charge from the charging pad 1704. As a result, cabinet-style wagering game machine can charge cell phones, personal digital assistants (PDAs), MP3 players, etc.

RF Harvesting

Figure 18:
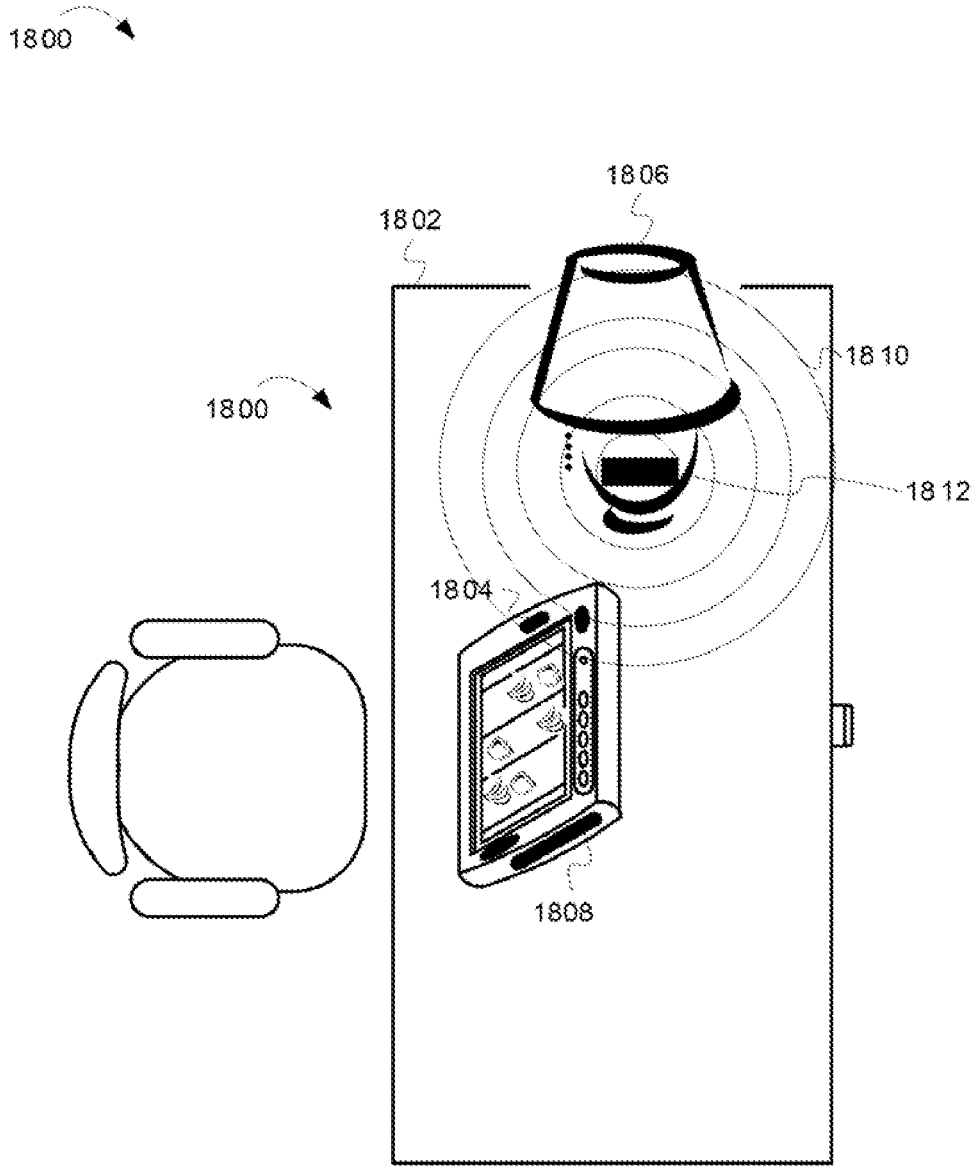
FIG. 18 is a perspective view of a Radio Frequency (RF) battery recharging system for handheld wagering game machines, according to example embodiments of the invention.

FIG. 18 is a perspective view of a Radio Frequency (RF) battery recharging system for handheld wagering game machines, according to example embodiments of the invention. In some embodiments, a transmitter 1812 transmits a radio frequency signal 1810 over a small area, and mobile wagering game machines can wirelessly harvest and use the signal's power. In some embodiments, the signal can continuously charge a handheld wagering game machine's battery 1808.

In some embodiments, the transmitter 1812 can be placed anywhere, such as in a lamp 1806 on a bar 1802. The transmitter 1812 in the lamp 1806 can send out a continuous RF signal 1810. Mobile wagering game machines equipped with RF harvesting receivers 1804 can continuously charge their batteries 1808. In some embodiments, the RF receiver 1804 is the size of a human fingernail. In some embodiments, the battery charging system 1800 can include Powercaster™ and Powerharvester™ modules, available from Powercast of Ligonier, Pa.

In some embodiments, a cabinet-style wagering game machines can include the transmitter 1812. Such embodiments my look similar to the embodiment shown in FIG. 17.

The battery charging system 1800 can provide a trickle charge to the battery 1808, thus increasing the handheld wagering game machine's usage time. For example, if a handheld wagering game machine's usage time without the battery recharging system 1800 is 5½ hours, by trickle-charging through a casino's battery charging system, usage time can be increased to 10 hours because the battery never goes dead. In some embodiments, the batter charging system 1800 can continuously charge handheld wagering game machines, so they can include sealed batteries (or no batteries) that are not accessed. In some embodiments, the battery charging system 1800 can be adapted to charge other devices, such as cell phones, pagers, mp3 players, etc.

Figure 19:
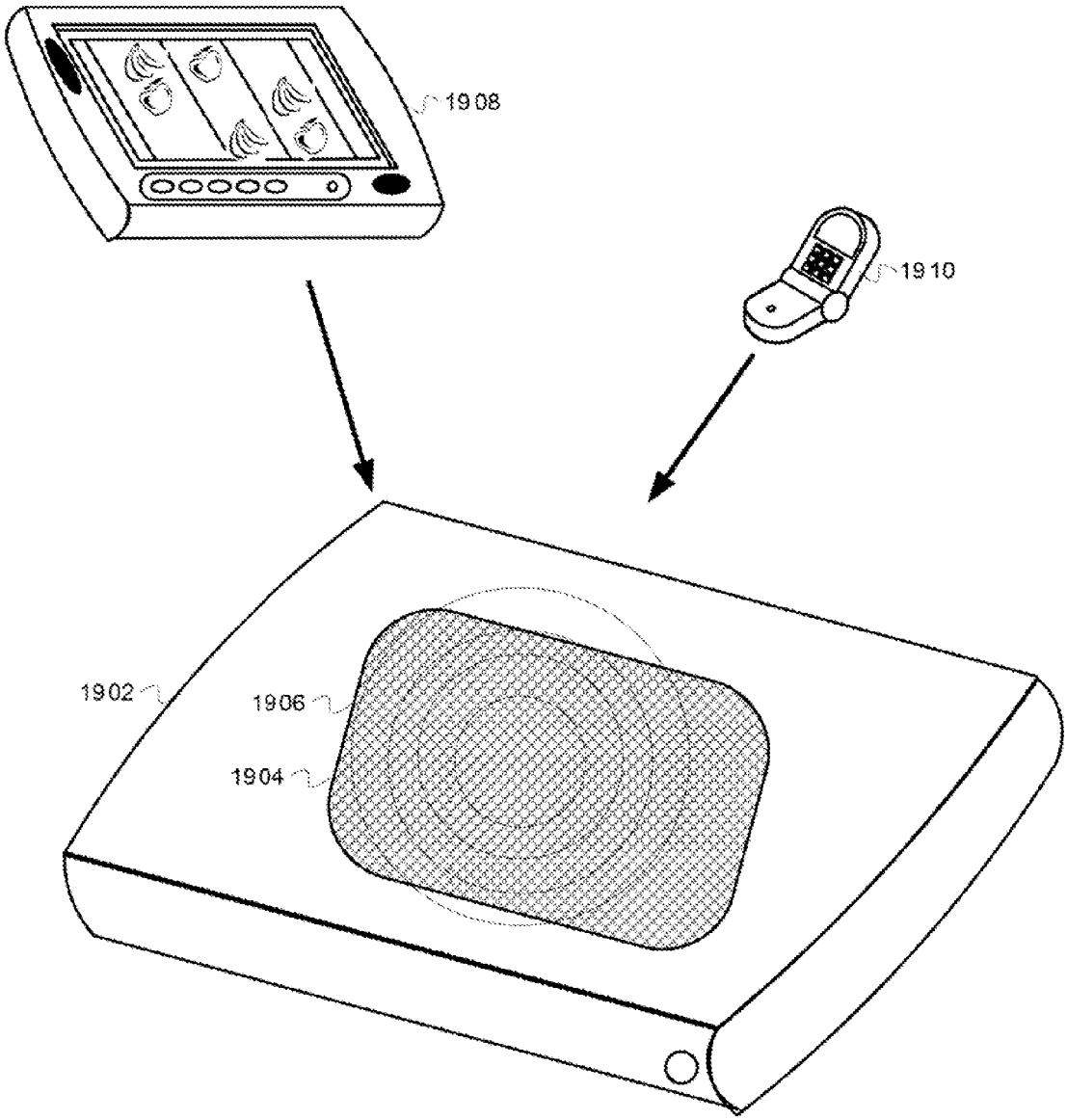
FIG. 19 shows a perspective view of a handheld wagering game machine including a wireless charging system, according to some embodiments of the invention.

FIG. 19 shows a perspective view of a handheld wagering game machine including a wireless charging system, according to some embodiments of the invention. In some embodiments, the handheld wagering game machine 1902 includes a wireless charging system similar to that described above. As shown, the handheld wagering game machine 1902 includes a charging pad 1904. The charging pad 1904 can emit an RF signal 1906 for charging wireless-charging-capable devices, such as other handheld wagering game machines 1908, cell phones 1910, mp3 players (not shown), etc. The handheld wagering game machine 1902 can receive power from a wall outlet or other power source and distribute power via the RF signal 1906. In some embodiments, the charging pad 1904 can provide power to other devices via inductive charging, where devices connect with the charging pad 1904 by contact surfaces, as described above.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole. This detailed description does not, therefore, limit embodiments of the invention, which are defined only by the appended claims. Each of the embodiments described herein is contemplated as falling within the inventive subject matter, which is set forth in the following claims.

The invention claimed is:

1. An apparatus comprising:

a wagering game docking station configured to dock with a handheld wagering game machine, the docking station including, a docking port configured to receive and adjustably hold the handheld wagering game machine at any of a plurality of viewing angles;

a plurality of buttons configured to send input to the handheld wagering game machine; and a mounting member configured to mount the docking station to a mounting surface, wherein the mounting member is connected to a bottom surface of the docking station, wherein the docking station is further configured to rotate about the mounting member after being mounted to the mounting surface.

2. The apparatus of claim 1, wherein the docking port is further configured to provide data and power to the handheld wagering game machine.

3. The apparatus of claim 1, wherein at least one of the buttons includes an organic light emitting diode configured to present graphical content.

4. The apparatus of claim 1, wherein the mounting member is further configured to plug into a mounting socket that is fastened to an underside of the mounting surface.

5. The apparatus of claim 1, the docking station further including a support member, wherein the mounting member is slidably attached to the support member, and configured to allow repositioning of the docking station on the mounting surface.

6. An apparatus comprising:

a handheld wagering game machine configured to present wagering games, the handheld wagering game device including, a first enclosure configured to contain components including, a central processing unit (CPU) configured to process information about the wagering games;

a power supply configured to provide power to the CPU;

a display device configured to display the information about wagering games; and a second enclosure configured to envelope the first enclosure, the second enclosure including a display opening, the display opening surrounding the display device.

7. The apparatus of claim 6, the second enclosure also containing a peripheral device.

8. The apparatus of claim 6, the second enclosure also containing a card reader connected to the CPU.

9. The apparatus of claim 6, wherein the first enclosure further includes a docking port configured to connect the handheld wagering game machine to a docking station.

10. The apparatus of claim 6, wherein the display device is flush to the display opening.

11. The apparatus of claim 6, wherein the first enclosure also includes a power switch, and wherein the second enclosure includes a power switch actuator connected to the power switch.

12. The apparatus of claim 6, wherein the second enclosure is suitable for insertion into a docking port of a docking station.

13. The apparatus of claim 6, wherein the first enclosure contains a power switch connected to the power supply, and wherein the second enclosure includes a switch actuator connected to the power switch.

14. A wagering game system comprising:

a docking station configured to be mounted on a surface, the docking station including, a plurality of buttons configured to receive input associated with wagering games; and a docking port configured to provide power and information associated with the wagering games; and a handheld wagering game machine configured to dock with the docking station, the handheld wagering game machine including, a display device configured to consume the power and to present some of the information; and a wagering game unit configured to receive the input and present the wagering games;

a primary enclosure configured to contain the display device and the wagering game unit; and a secondary enclosure configured to contain the primary enclosure and a peripheral device.

15. The wagering game system of claim 14, the docking port further configured to hold the handheld wagering game machine at any one of a plurality of user selected viewing angles.

16. The wagering game system of claim 14, the docking port including a pivotable connection cylinder configured to support the handheld wagering game machine at a plurality of present viewing angles.

17. The wagering game system of claim 14, wherein the handheld wagering game machine includes a primary enclosure and a secondary enclosure.

18. The wagering game system of claim 14, wherein the docking station includes a mounting member configured to mount the docking station to the surface, and wherein the docking station is further configured to rotate about the mounting member after being mounted to the surface.

* * * * *